US007487878B2

(12) United States Patent
Giwargis et al.

(10) Patent No.: US 7,487,878 B2
(45) Date of Patent: Feb. 10, 2009

(54) APPARATUS FOR ELEVATING OBJECTS STORED IN A CONTAINER

(76) Inventors: Panipal Giwargis, 6741 N. California, Chicago, IL (US) 60645; Ninos Youkhana, 480 Edgewood La., Northfield, IL (US) 60093

( * ) Notice: Subject to any disclaimer, the term of this patent is extended or adjusted under 35 U.S.C. 154(b) by 101 days.

(21) Appl. No.: 11/532,140

(22) Filed: Sep. 15, 2006

(65) Prior Publication Data

US 2007/0056968 A1 Mar. 15, 2007

Related U.S. Application Data

(63) Continuation-in-part of application No. 11/210,955, filed on Aug. 24, 2005.

(51) Int. Cl.
*B65H 1/08* (2006.01)
*B65G 59/02* (2006.01)

(52) U.S. Cl. ..... 220/23.83; 221/198; 221/279; 221/255

(58) Field of Classification Search ..... 220/23.83, 220/559, 8; 221/198, 260, 279, 255
See application file for complete search history.

(56) References Cited

U.S. PATENT DOCUMENTS 2,110,615 A * 3/1938 Wilcox ..... 206/525
2,801,769 A * 8/1957 Will ..... 221/260
2,814,057 A * 11/1957 Burns ..... 441/35
2,849,154 A * 8/1958 Gartrell et al. ..... 221/260
2,876,930 A * 3/1959 Will ..... 221/260
3,439,827 A * 4/1969 Marland ..... 215/12.1
5,191,996 A * 3/1993 Jenkins ..... 221/64
5,337,915 A * 8/1994 Hall, Jr. ..... 220/495.11
5,634,569 A * 6/1997 DeCoster ..... 220/735
6,036,038 A * 3/2000 Lovelace et al. ..... 215/391
6,634,921 B1 * 10/2003 Coulthard, Jr. ..... 446/221
6,745,918 B2 * 6/2004 Greene ..... 221/198

* cited by examiner

*Primary Examiner*—Anthony D Stashick
*Assistant Examiner*—Niki M Eloshway

(57) ABSTRACT

An apparatus for selectively elevating objects stored in a container, the apparatus comprising a lift that includes a base, at least one guide having a first end coupled to the base, and an outer ring, wherein the at least one guide includes a second end coupled to the outer ring, whereby the outer ring may be vertically adjusted along a container sidewall surface resulting in vertical adjustment of the base within the container interior. The base may be configured to provide for insertion of objects through an opening in the base, allowing objects to be inserted into the container through the opening and prior to closing the opening.

11 Claims, 5 Drawing Sheets

APPARATUS FOR ELEVATING OBJECTS STORED IN A CONTAINER

This is a continuation-in-part application of Ser. No. 11/210,955 filed Aug. 24, 2005, currently pending, entitled, "Apparatus and Method for Elevating Objects Stored in a Container" for which priority is claimed and which is incorporated herein by reference.

FIELD OF THE INVENTION

Invention relates to a device for selectively elevating objects stored in containers. More particularly, the invention relates to a device for elevating stacked objects, such as food products, stored in upright containers.

BACKGROUND

Upright containers of various sizes and configurations are used to store objects. For example in the food industry, cylindrical and rectangular containers are often used to store stacked foodstuffs such as, but not limited to, potato chips, cookies, and crackers. Prior art devices include elevating dispensers that use (1) a sling (U.S. Pat. No. 6,745,918) or (2) a vertically adjustable flexible bag (U.S. Pat. No. 5,337,915) as the lifting device. What is needed is a simple lifting device that supports and suspends objects stored in containers.

SUMMARY OF THE INVENTION

This invention relates to an apparatus for selectively elevating objects stored in containers, the apparatus in one embodiment comprising: a container that includes a bottom wall, and at least one sidewall extending from the bottom wall, the sidewall having an outer surface, an inner surface extending around an open interior of the container, an outer surface, and a top edge extending around an opening of the container, the opening providing access to the container interior; and a lift, comprising a base positioned in the container interior; at least one guide having a first end coupled to the base; and an outer ring positioned adjacent the container sidewall outer surface, wherein the at least one guide includes a second end coupled to the outer ring, whereby the outer ring may be vertically adjusted along the container sidewall outer surface resulting in vertical adjustment of the base within the container interior.

The container lift device can be used in many different applications including, but not limited to, the fields of packaging for food products, sporting goods, and medical supplies. In other applications of the invention it may also be desirable to form the container with the sidewalls and bottom wall having a different configuration from that shown. Different shapes or configurations may be adapted for different applications. The invention can also be constructed to accommodate various manufacturing processes such as top or bottom loading of product in the desired container prior to shipment and sale. Additional embodiments of the present invention allow the lift apparatus to be used in a manufacturing process where the container is filled with product through its bottom wall.

BRIEF DESCRIPTION OF THE DRAWINGS

Further objects and features of the present invention are revealed in the following detailed description of the preferred embodiments of the invention and the drawing figures wherein.

DETAILED DESCRIPTION

Figure 1:
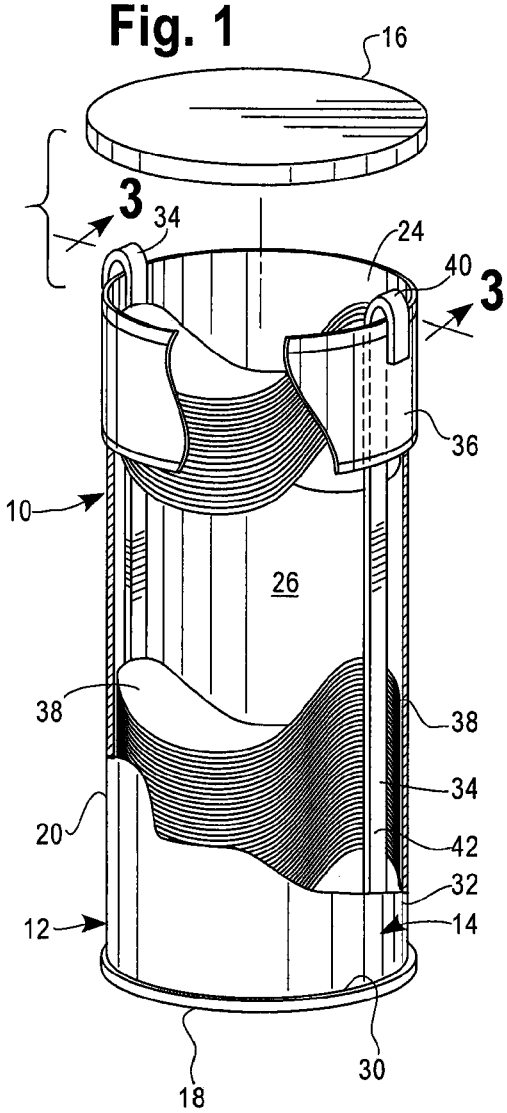
FIG. 1 illustrates a perspective view of an embodiment of the present invention comprising an apparatus for selectively elevating objects stored in a container.

A detailed description of the present invention is described herein with reference to the accompanying drawing figures. Terms of reference such as "top," "bottom," or "side" are used to facilitate an understanding of the present invention in view of the accompanying figures. The identified reference terms or other similar terms are not intended to be limiting, and one of ordinary skill in the art will recognize that the present invention may be practiced in a variety of spatial orientations without departing from the spirit and scope of the invention.

In the most general form, the invention relates to an apparatus for selectively elevating or lifting objects stored in an upright container. The accompanying drawings at FIGS. 1-4 show, as an illustrative embodiment, an apparatus 10 formed in accordance with the teachings of the present invention. As best seen in FIG. 2, the apparatus 10 includes a container 12, a lift 14 and a sealing cover member 16 releasably securable over a top opening of the container 12.

In the illustrative embodiment of FIGS. 1-4, the container 12 is comprised of a substantially round or circular bottom wall 18 and a sidewall 20. The sidewall 20 extends upwards from the bottom wall 18, forming an open top cylindrical container. More particularly, as best seen in FIG. 2, the container 12 may include a bottom wall 18 and at least one sidewall 20 extending from the bottom wall 18, the sidewall 20 having an inner surface 24 extending around an open interior 24 of the container 12 and the sidewall 20 having an outer surface 26 that forms the exterior of the container 12. The sidewall 20 also includes a top edge 28 extending around the opening interior 24 of the container 12. The open interior 24 provides access to the interior of the container 12.

In other applications of the invention, it may be desirable to form the container with the sidewalls and bottom wall having a configuration other than that shown. For example, if the assembly 10 is used to store crackers, slices of bread or magazines, the container of the apparatus would have the general configuration of a rectangle or square. For different applications, other shapes may also be utilized.

The container 12 may be constructed of fiberboard, for example, but not limited to, cardboard. However, other types of materials, such as for example, molded plastic, or other methods of construction may be employed in constructing the apparatus of the invention.

The cover member 16 of the apparatus 10 may be configured to engage in a snap fit, sealed engagement over the top edge 28 of the container 12 and completely enclose the container interior 24, as best seen in FIG. 2. The cover member 16 may be molded from plastic. However, the cover member 16 may be constructed from other materials and by other methods.

Figure 2:
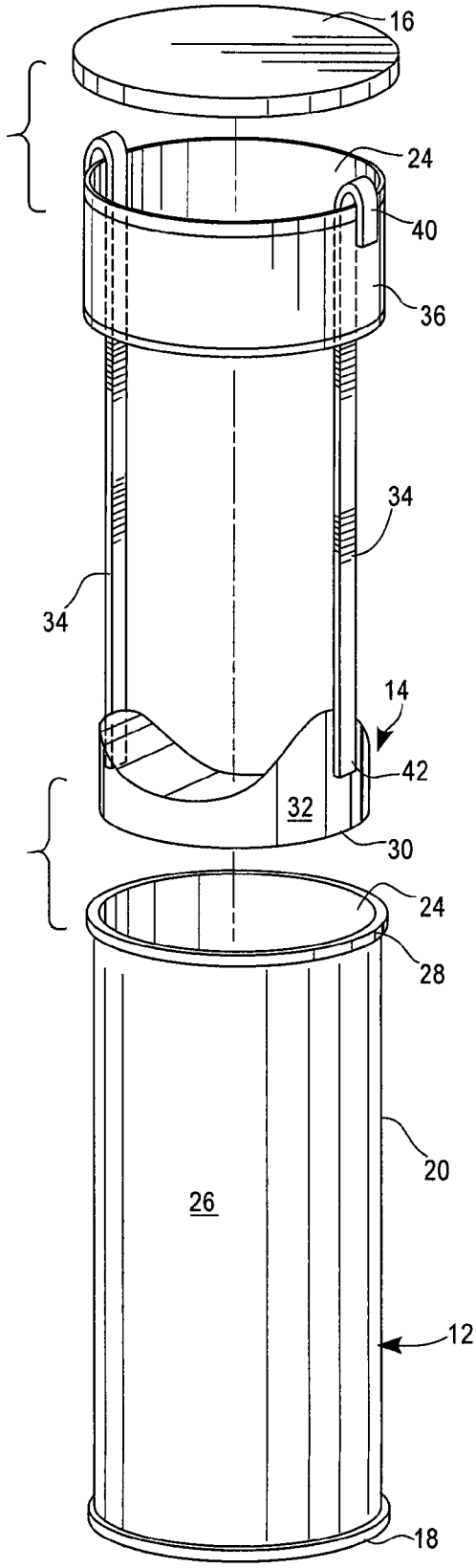
FIG. 2 is an exploded perspective assembly view of the apparatus shown in FIG. 1.
Figure 3:
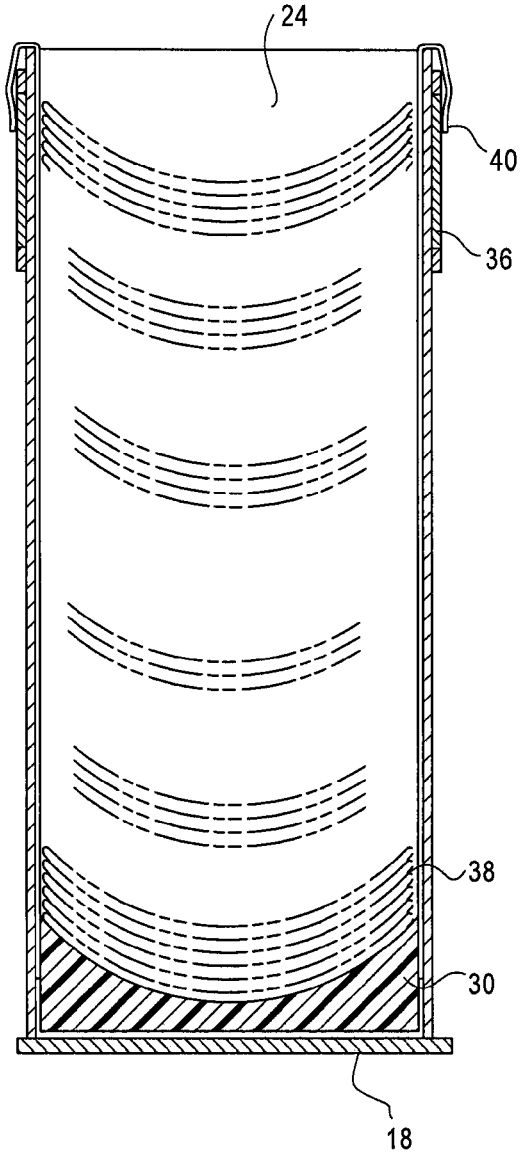
FIG. 3 is section view taken along the line 3-3 shown in FIG. 1, showing one position of the apparatus.
Figure 4:
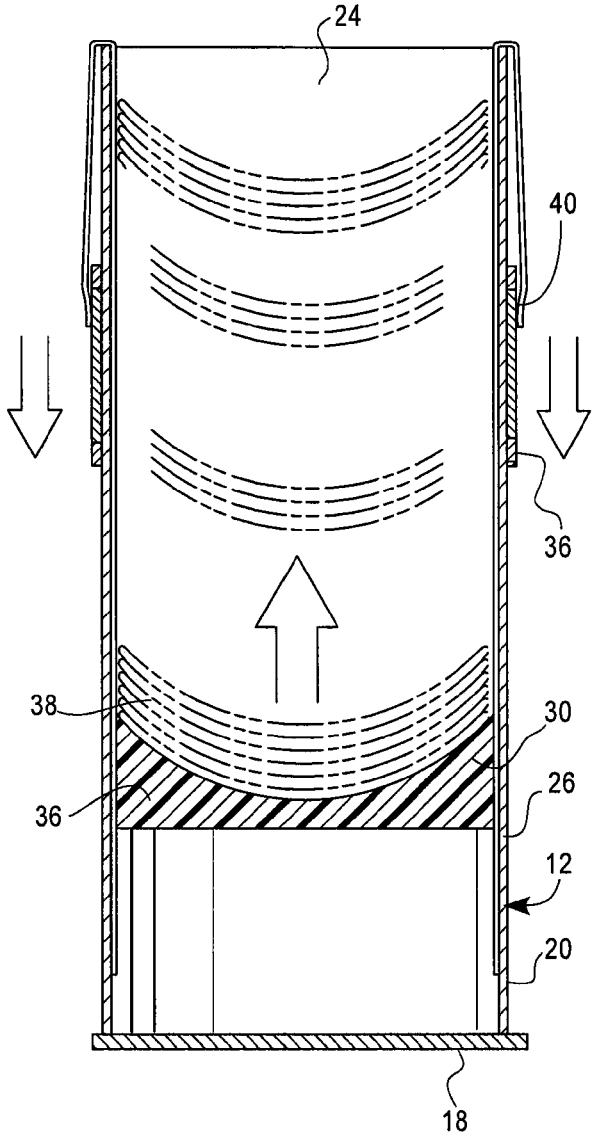
FIG. 4 illustrates one method of suspending a portion of the apparatus during use.

As best seen in FIGS. 1 and 2, the lift 14 may include a base 30, one or more guides 34 and an outer ring 36. The base 30 is used to elevate or lift the objects stored in the container 12, as best seen in FIGS. 1 and 3-4. The base 30 may be configured having a form and size that permit it to be placed in the interior of the container with which it is to be used. In the embodiment shown, the base 30 has a circular cross-section. The base 30 may also be constructed to include a sidewall 32. As best seen in FIG. 2, the sidewall 32 may extend around at least a portion of the base 30.

As shown in FIGS. 1 and 2, the lift 14 includes at least one guide 34. Although the illustrative embodiment shows two guides 34, it will be appreciated by one of ordinary skill in the art 30 that the lift could be constructed using any number of guides. The guide 34 is an elongated member. As best seen in FIG. 2, the guide includes a first end 42 supported by the base and a second end 40 supported by the outer ring 36 (discussed below). The guide 34 should include a length that permits adjustment of the base 30 at any point between the top edge 28 and the bottom 18 of the container 12.

The lift 14 also includes an outer ring 36. In the illustrated embodiment, the outer ring 36 is configured having a circular shape. It will be appreciated, however, that the outer ring 36 may be constructed in a configuration and size that permit it to the traverse the surface of the container with which it will be used. For example, in the illustrated embodiment, when incorporated in the assembly 10, the outer ring 36 extends around at least a portion of the exterior sidewall surface 26, as best seen in FIG. 1. Hence, a circular configuration of the outer ring 36 was chosen.

As best seen in FIGS. 1 and 2, a portion of the outer ring 36 supports a portion of the guides 34 such that the outer ring 36 may be vertically adjusted along the exterior sidewall surface 26, resulting in vertical adjustment of the base 30 within the container 12 interior.

The outer ring 36 and the base 30 may be constructed of fiberboard, for example cardboard or other suitable materials that will permit frictional engagement between the outer ring 36 and the exterior sidewall surface 26. The outer ring may also be configured to carry graphic information, such as but not limited to, coupons or games of chance.

The guides 34 may be constructed of a flexible material having suitable strength and flexibility to support the base 30 and the contents of the container 12 and to travel along the inner and outer surfaces of the container 12 as the outer ring 36 is vertically adjusted along the exterior sidewall surface 26.

As best seen in FIG. 1, the apparatus 10 is formed by placing a portion of the lift 14 in the interior of the container 12 and by placing a portion of the lift 14 adjacent the exterior of the container 12. As shown in FIG. 1, the base 30 may be placed in the container's open center 24, and the outer ring 36 may be positioned adjacent the outer exterior surface 26 of the container 12. This arrangement causes the guides 34 to extend along the height of the container, and permits selective positioning of the base 30 within the open center 24 by vertically adjusting the position of the outer ring 36 along the outer exterior surface 26 of the container 12. When the lift 14 is being used to lift or suspend objects, the inner surface of the outer ring 36 may frictionally engage the exterior sidewall surface 26 to suspend the outer ring 36 in position along the exterior sidewall surface 26, resulting in the base 30 being suspended in the container interior.

In other embodiments, the outer ring 36 may engage in sliding friction engagement with the exterior sidewall surface 26 to suspend the base 30 in an adjustable position above the container bottom 18, enabling adjusting a suspended position of the base 30 above the container bottom 18 in a first direction away from the container bottom 18 in response to sliding the outer ring 36 along the exterior sidewall surface 26 in a second direction opposite to the first direction.

Regardless of the embodiment used, the friction engagement between the outer ring 36 and the exterior sidewall surface 26 should be sufficient to suspend the base 30 and the food products 38 supported by the base 30 in the container interior 24 in a variety of vertically adjusted positions above the container bottom 18.

More particularly, vertically adjusting the outer ring 36 along the exterior surface sidewall 26 permits selective positioning of the base 30 and food product 38 in a vertically adjusted position relative to the container bottom 18. For example, by sliding the outer ring 36 in a downward direction along the exterior sidewall surface 26, the base 30 and the food product 38 will rise in the container 12 interior relative to the container bottom 18 and the food products contained in the container 12 will be moved toward and above the top edge 28 of the container 12 as shown in FIGS. 3 and 4. In this manner, the food products 38 supported by the base 30 may be raised to the top of the container 12 and dispensed from the container top opening, or may be lowered down into the container interior below the container top opening.

In one embodiment, a method for elevating stacked items using a lift 14 as taught herein may include (1) providing a container having a bottom wall and at least one sidewall supported by the bottom wall, the sidewall having an inner surface extending around an open interior of the container, an outer surface, and a top edge extending around an opening of the container, the opening providing access to the container interior; (2) providing a lift assembly including a base positioned in the container interior; at least one guide having a first end coupled to the base; and an outer ring positioned adjacent the container sidewall outer surface, wherein the at least one guide includes a second end coupled to the outer ring; (3) adjusting vertically the outer ring along the container sidewall outer surface, wherein the inner surface of the outer ring engages in friction engagement with the container sidewall outer surface to suspend the outer ring in position along the container sidewall outer surface; and (4) suspending the base in the container interior by the friction engagement of the inner surface of the outer ring and the container sidewall outer surface.

The container lift device of the present invention can be used in many applications including sporting goods containers, such as those containing tennis balls, golf balls, or the like, as well as in the area of containers for food and medical supplies. The base of the lift device of the present invention will have an outer shape that conforms to the shape of the inside of container. Further the invention is designed to accommodate the relevant manufacturing process for the desired product to be inserted in the container. Assembly and installation of the invention can be accomplished for various manufacturing processes; for example, the invention can accommodate top or bottom loading of product in the desired container. As shown in FIGS. 5-11, alternative embodiments of the present invention include different structures for the base 30 as compared to that shown in FIGS. 1-4. These alternative structures allow the invention to be used in a manufacturing process where the container is filled through the bottom wall with product prior to shipment and sale.

Figure 5:
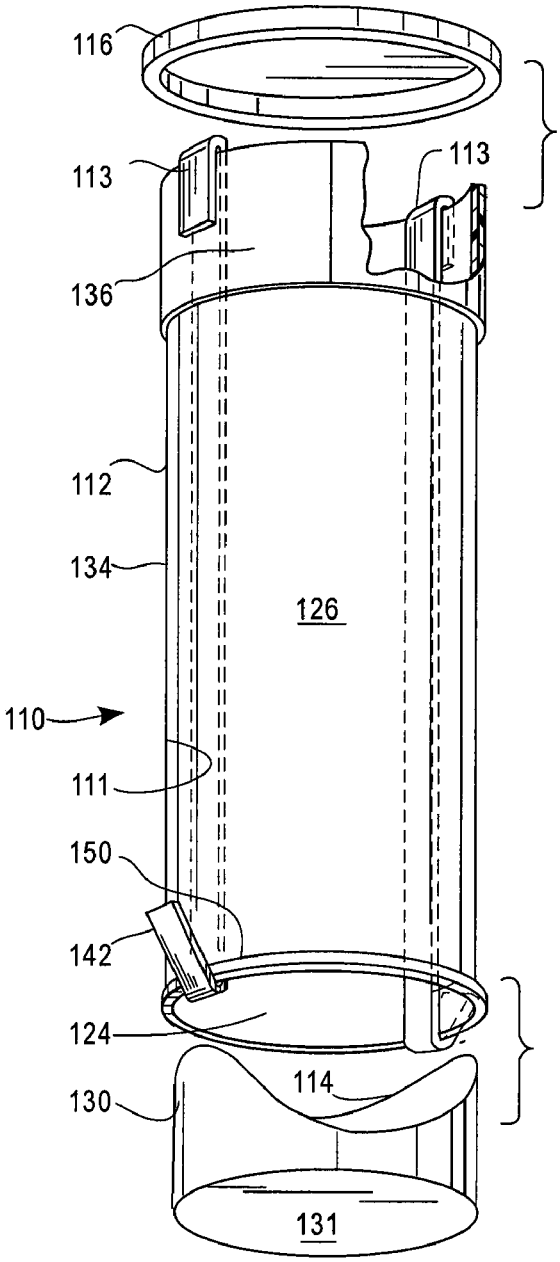
FIG. 5 is a perspective assembly view of an alternative embodiment of the apparatus shown in FIG. 1, where the container is inverted and product is adapted to be filled through the bottom of the container.
Figure 6:
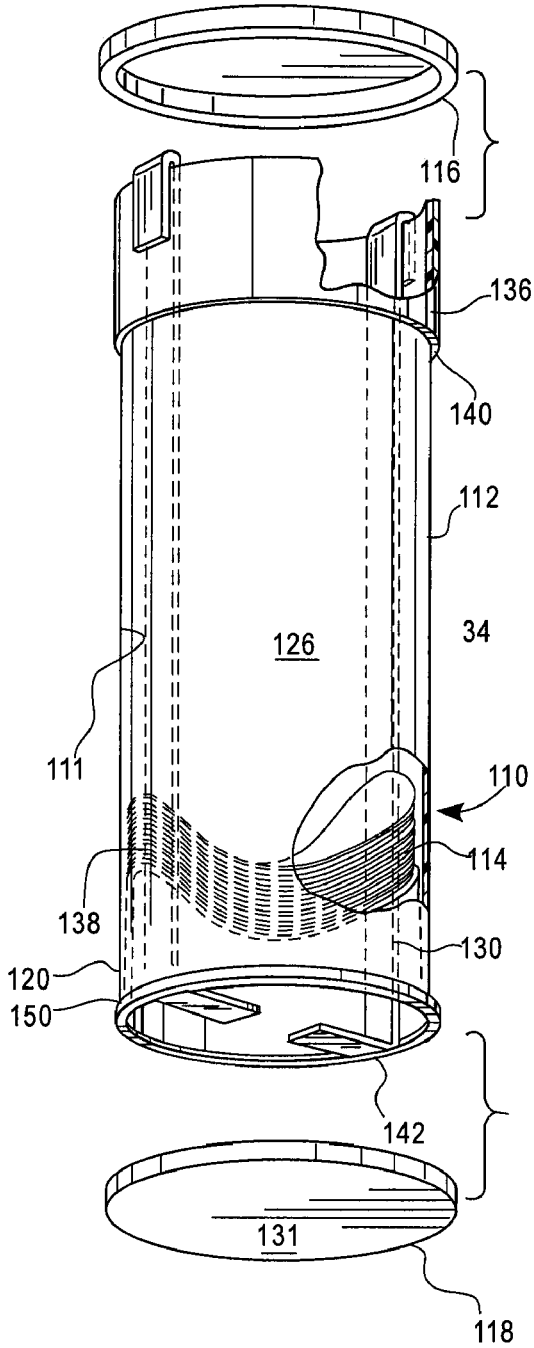
FIG. 6 is another assembly view of the embodiment of the apparatus shown in FIG. 5.

In the embodiment shown in FIGS. 5-6, product is loaded through the bottom of the container apparatus 110. The container 112 is shown in an inverted position. The bottom wall 118 (FIG. 6) of the container 112 has a first open position and a second closed position. The bottom wall 118 is removeably attached to a bottom edge 150 of the container and can be removed from the container 112 when objects are to be loaded into the container 112 through the opening formed by the bottom edge 150. The container 112 also includes a sidewall 120 extending from the bottom edge 150 of the container to a top edge 113 of the container. The top edge forms a second opening to provide access to the objects in the container by a user of the container. The apparatus 110 is formed by initially placing a portion 114 of the base 130 of the lift device adjacent the interior surface of the container 112. The base 130 includes a bottom surface 131 from which portion 114 extends. The outer ring 136 is slidably positioned adjacent the outer exterior surface 126 of the container 112 with the second end 140 of each guide 134 extending along the inner surface 111 of container 112, over the top of the container as shown at 113, and attached to the outer ring 136. Product 138 is inserted into the container. The product 138 is maintained in the container 112 while in the inverted position by a cover 116 which fits tightly over the top edge 113 of the container 112.

As shown in FIG. 6, after the container 112 has been filled with product 138, the base 130 is then dropped into the container's open center 124. The first end 142 of each of the guides 134 is tacked, by glue or other similar means, to the outer edge of the base 130 of the lift device inside the container 112. The bottom wall 118 is then placed over base 130, and the bottom wall 118 is sealed along the bottom edge 150 of the sidewall 120.

In use, the container 112 is re-inverted to its normal position with the product secured inside. Vertically adjusting the outer ring 136 along the exterior surface sidewall 126 pulls guides 134 over the top edge of the container 112, thus permitting selective positioning of the base 130 and food product 138 in a vertically adjusted position relative to the container bottom wall 118. By sliding the outer ring 136 in a downward direction along the exterior sidewall surface 126, the base 130 and the food product 138 will rise in the container 112 interior relative to the container bottom wall 118 and the food product will be accessible to the user. The food product 138 supported by the base 130 of the lift device may be raised to or above the top edge 113 of the container 112. In this manner, the food product 138 may be dispensed from the container top opening or may be lowered down into the container interior again for storage. In this embodiment, there may be sufficient friction between the outer ring 136 and the surface 126 of container 112 to retain outer ring 136 at the last vertical position set by the user. Alternatively, there may be a loose fit between outer ring 136 and surface 126 of container 112, whereby after use, the weight of the product 138 may drive base 131, and the product supported by the base, downward towards the bottom wall 118. In addition, cover 116 may fit tight enough over top edge 113 of container 112 to prevent movement of guides 134 once cover 116 is replaced on top edge 113 after the user has extracted product from the container.

Figure 7:
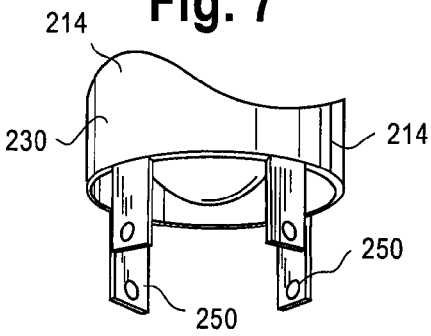
FIG. 7 is a detail perspective view of the base of the lift device shown in the open position for the embodiment shown in FIGS. 8 and 9.
Figure 8:
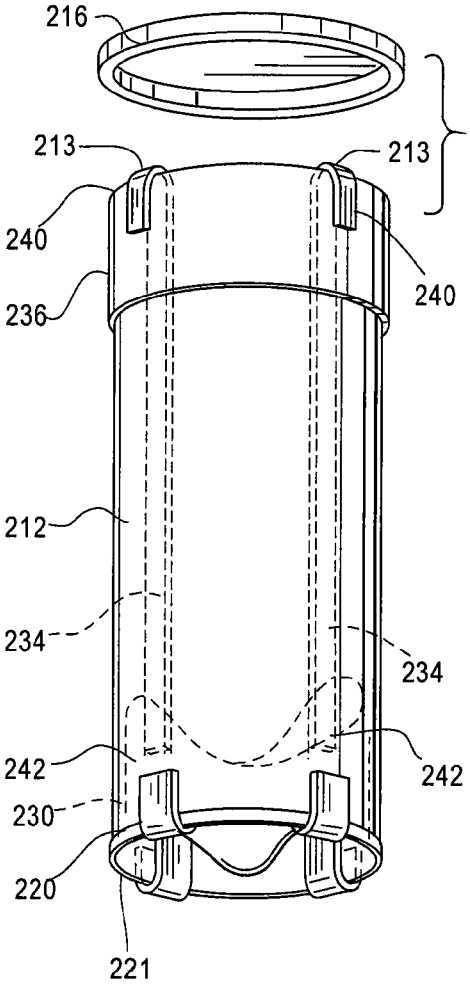
FIG. 8 illustrates an alternative embodiment of the apparatus of the present invention.
Figure 9:
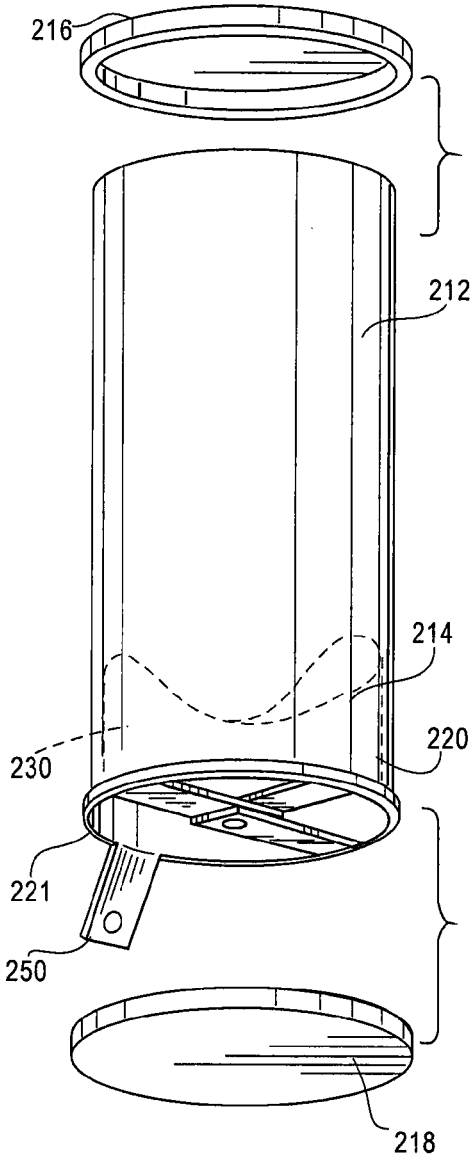
FIG. 9 illustrates an assembly view of another step in the installation of the lifting device of the apparatus shown in FIG. 8.

FIGS. 7-9 illustrate another embodiment of the present invention where the base 230 of the lift device is moveable between an open position and a closed position. The base 230 includes prong-like extensions 250, which may be bent ninety degrees from the plane of the base to engage and overlap the sidewall 220 of the container 212 to hold the base 230 in place as the container 212 is filled with product. The base 230 in this embodiment is adapted to be placed in the bottom of container 212 before or after product is inserted into the container 212. Product is inserted into the container 212 through the opening formed through base 230. The first end 242 of each guide 234 is suitably tacked to the inner surface of the base 230 at portions 214. The second end 240 of each guide 234 extends over the top of the container at 213, and each guide 234 is then attached to the outer ring 236. As shown in FIG. 9, after the container 212 is filled with product, the extensions 250 of the base 230 are then tacked or glued together to provide support for the product when the container 212 is re-inverted to its normal position. The bottom wall 218 is then placed over the base 230, and the bottom wall 218 is sealed along the bottom edge 221 of the sidewall 220 of container 212.

When used by a consumer, the operation of the container 212 is the same as the operation of the embodiment shown in FIGS. 5-6. The prong-like extensions 250 in their closed position (FIG. 9) provide sufficient strength to support the product on base 230.

Figure 10:
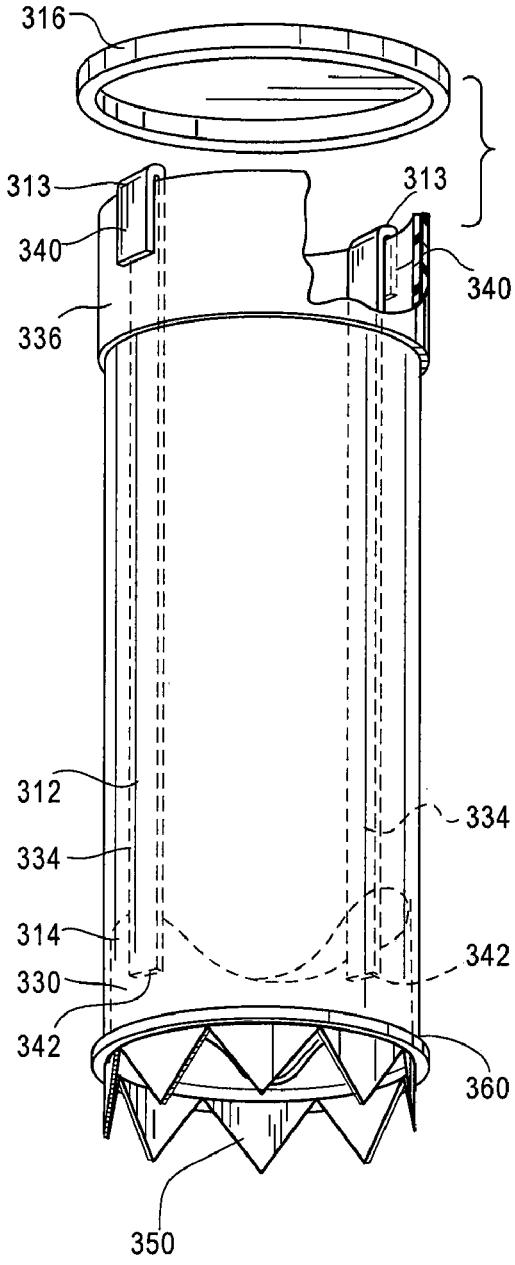
FIG. 10 is a partially assembled view of a further embodiment of the apparatus of the present invention.
Figure 11:
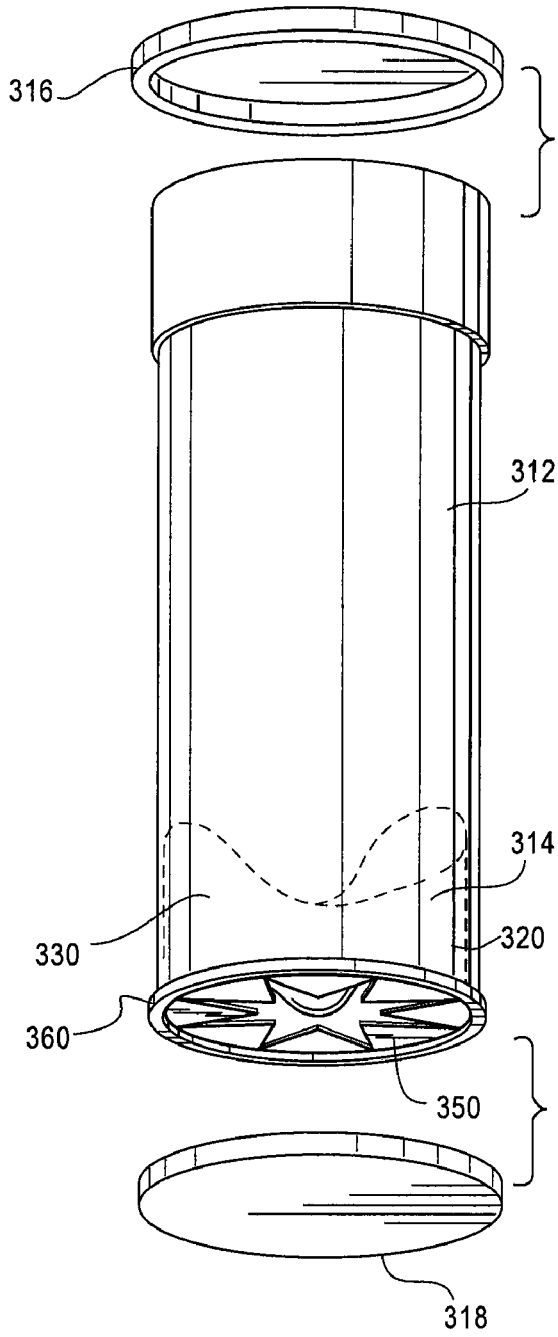
FIG. 11 is an assembly view of the embodiment of the present invention shown in FIG. 10 at another step of the installation of the lift device.

FIGS. 10-11 illustrate another alternative embodiment of the lift device of the present invention. In this embodiment, the base 330 for the lift includes teeth-like extensions 350 around the circumference of the base 330, each extension having a first open position (FIG. 10) and a second closed position (FIG. 11). A number of the extensions 350 around the circumference of the base may be bent ninety degrees from the plane of the base to engage and overlap the sidewall 320 of the container 312 to hold the base 330 in place as the container 312 is filled with product. As with the embodiment shown in FIGS. 7-9, the base 330 in this embodiment is adapted to be placed in the bottom of container 312 before or after product is inserted into the container 312. Product is inserted into the container 312 through the opening formed through base 330. The first end 342 of each guide 334 is suitably tacked to the inner surface of the base 330 at portions 314. The second end 340 of each guide 334 extends over the top of the container at 313, and each guide 334 is then attached to the moveable outer ring 336. As shown in FIG. 11, after the container 312 is filled with product through open base 330 (FIG. 10), the teeth-like extensions 350 are closed to provide support for the product on the base 330 when the container 312 is re-inverted to its normal position. The bottom wall 318 is then placed over the base 330 and the bottom wall 318 is sealed along the bottom edge 360 of the sidewall 320 of the container 312.

When used by a consumer, the operation of the container 312 is the same as the operation of the embodiment shown in FIGS. 8-9. The teeth-like extensions 350 in their closed position (FIG. 11) provide sufficient strength to support the product on base 330.

While the present invention has been described by reference to a specific embodiment, it should be understood that modifications and variations of the invention may be constructed without departing from the scope of the invention defined in the following claims. For example, the apparatus of the invention may be employed in lifting and suspending objects other than food products. In the Detailed Description, the invention is illustrated using food products, specifically, stacked potato chips. However, this illustration of the invention should not be interpreted as limiting, as one of ordinary skill in the art would realize that certain modifications would come within the teachings of this invention without departing from the spirit and scope of the appended claims. Therefore, the following claims should be studied to determine the true scope and content of the invention.

What is claimed is:

1. An apparatus for selectively elevating objects stored in a container, the apparatus comprising:

the container including an interior and a bottom wall, the bottom wall having a first position closing the container interior and a second position opening the container interior, the container also including at least one sidewall connected to and extending from the bottom wall when the bottom wall is in said closed position, the sidewall having an outer surface forming an exterior of the container, an inner surface extending, around an open interior of the container, and a top edge extending around an opening of the container, the opening providing access to the container interior, a cover member removeably placed over the top edge of the container;

a lift device comprising a moveable base slidably positioned in the container interior, the base having a sidewall portion and a bottom portion, the base adapted to support objects placed into the container, the base providing access to the container interior when the base is in a first position, and closing access to the container interior when the base is in a second position;

at least one guide having a first end adapted to be coupled to the base; and an outer ring positioned adjacent the container sidewall outer surface, the at least one guide including a second end adapted to be coupled to the outer ring, the outer ring being vertically adjustable along the container sidewall outer surface providing vertical adjustment of the base within the container interior.

2. The apparatus of claim 1 wherein the base is removed from the container interior in said first position, and the base is located in the container interior in said second position.

3. The apparatus of claim 1 wherein an inner surface of the outer ring frictionally engages the container sidewall outer surface to suspend the outer ring in an adjustable position along the container sidewall outer surface, the base suspended in the container interior by the friction engagement of the inner surface of the outer ring and the container sidewall outer surface.

4. The apparatus of claim 1, wherein the outer ring is in frictional engagement with the container sidewall outer surface suspending the base in an adjustable position above the container bottom wall in a first direction away from the container bottom wall in response to sliding the outer ring along the container sidewall outer surface in a second direction, the second direction being opposite the first direction.

5. An apparatus for selectively elevating objects stored in a container, the apparatus comprising:

the container including an interior and a bottom wall, the bottom wall having a first position closing the container interior and a second position opening the container interior, the container also including at least one sidewall connected to and extending from the bottom wall when the bottom wall is in said closed position, the sidewall having an outer surface forming an exterior of the container, an inner surface extending around an open interior of the container, and a top edge extending around an opening of the container, the opening providing access to the container interior, a cover member removeably placed over the top edge of the container;

a lift device comprising a moveable base slidably positioned in the container interior, the base having a sidewall portion and a bottom portion, the base adapted to support objects placed into the container, the base adapted to provide access to the container interior when the base is in a first position, and closing access to the container interior when the base is in a second position;

at least one guide having a first end adapted to be coupled to the base;

an outer ring positioned adjacent the container sidewall outer surface, the at least one guide including a second end adapted to be coupled to the outer ring, the outer ring being vertically adjustable along the container sidewall outer surface providing vertical adjustment of the base within the container interior; and the base of the lift device further including at least one extension having a first open position and a second closed position, the first open position adapted to allow product to pass through the base into the container interior, and the second closed position adapted to provide support for product stored in the container and resting on the lift device.

6. The apparatus of claim 5 wherein the base includes at least one extension, said at least one extension bent ninety degrees from the plane of the base to engage and overlap the sidewall of the container, holding the base in the first open position.

7. The apparatus of claim 6 wherein the at least one extension comprises a plurality of extensions, each extension having an outer portion, said plurality of extensions folded to a position parallel to the plane of the base, the outer portions of each extension being joined together in the second closed position of said base.

8. The apparatus of claim 7 wherein each outer portion of each extension includes a mechanical fastener adapted to secure the outer portion of all extensions together forming said base.

9. The apparatus of claim 7 wherein each outer portion of each extension includes a chemical fastener adapted to secure the outer portions of all extensions together forming said base.

10. An apparatus for selectively elevating objects stored in a container, the apparatus comprising:

the container including an interior and a bottom wall. the bottom wall having a first position closing the container interior and a second position opening the container interior, the container also including at least one sidewall connected to and extending from the bottom wall when the bottom wall is in said closed position, the sidewall having an outer surface forming an exterior of the container, an inner surface extending around an open interior of the container, and a top edge extending around an opening of the container, the opening providing access to the container interior, a cover member removeably placed over the top edge of the container;

a lift device comprising a moveable base slidably positioned in the container interior, the base having a sidewall portion and a bottom portion, the base adapted to support objects placed into the container, the base adapted to provide access to the container interior when the base is in a first position, and closing access to the container interior when the base is in a second position;

at least one guide having a first end adapted to be coupled to the base;

an outer ring positioned adjacent the container sidewall outer surface, the at least one guide including a second end adapted to be coupled to the outer ring, the outer ring being vertically adjustable along the container sidewall outer surface providing vertical adjustment of the base within the container interior; and the base of the lift device further including a plurality of tooth-like extensions, each extension pivotally mounted to the sidewall portion of the lift device at a first lower end of said extensions, each said extension also including a pointed end forming a second upper end of each said extension.

11. The apparatus of claim 10, wherein the plurality of extensions form the base of the lift device when said extensions are pivoted to and maintained in a common plane.

* * * * *